US005704329A

United States Patent [19]

Bublitz et al.

[11] Patent Number: 5,704,329

[45] Date of Patent: Jan. 6, 1998

[54] ENGINE FRONT COVER

[75] Inventors: Heiko Bublitz, Stuttgart; Roland Doll, Weilheim; Uwe Kooths; Peter Lindeckert, both of Stuttgart, all of Germany

[73] Assignee: Mercedes-Benz AG, Stuttgart, Germany

[21] Appl. No.: 813,409

[22] Filed: Mar. 10, 1997

[30] Foreign Application Priority Data

Mar. 28, 1996 [DE] Germany ..... 196 12 359.3

[51] Int. Cl.[6] ..... F02F 7/00

[52] U.S. Cl. ..... 123/195 A; 123/195 C

[58] Field of Search ..... 123/195 C, 195 A

[56] References Cited

U.S. PATENT DOCUMENTS 3,951,123 4/1976 Hill ..... 123/195 A 4,561,386 12/1985 Tamba et al. ..... 123/195 C 4,998,515 3/1991 Carvalho ..... 123/195 C 5,125,376 6/1992 Williams et al. ..... 123/195 A 5,477,817 12/1995 Hufendiek et al. ..... 123/195 C

*Primary Examiner*—Erick R. Solis

*Attorney, Agent, or Firm*—Klaus J. Bach

[57] ABSTRACT

In a front cover which is mounted on the front end of an internal combustion engine to cover an engine camshaft drive mechanism and which includes means for supporting auxiliary engine components such as a power steering pump, the front cover further includes a slide-in mounting structure supporting a container which, when inserted into the slide-in mounting structure, is firmly supported by the front cover and communicatively connected to an auxiliary engine component.

8 Claims, 2 Drawing Sheets

ENGINE FRONT COVER

BACKGROUND OF THE INVENTION

The invention relates to an engine front cover mounted on the front end of an internal combustion engine and adapted to support engine accessories particularly the alternator, the a/c compressor, the power steering pump and the water pump.

DE 42 11 896 A1 discloses an engine front cover for an internal combustion engine on which engine accessories such as an oil pump, an air compressor, a heat exchanger, an oil filter, a coolant pump and a cooling water thermostat are mounted.

For further general technical background, reference is made to DE 44 00 952 C1. (U.S. Pat. No. 5,477,817)

It is the object of the present invention to provide such an engine front cover in such a way that it can support additional components with little space requirements and with such an arrangement and a shape that it can be manufactured in a simple and inexpensive manner.

SUMMARY OF THE INVENTION

In a front cover which is mounted on the front end of an internal combustion engine to cover an engine camshaft drive mechanism and which includes means for supporting auxiliary engine components such as a power steering pump, the front cover further includes a slide-in mounting structure supporting a container which when inserted into the slide-in mounting structure is firmly supported by the front cover and communicatively connected to an auxiliary engine component.

Since with the arrangement according to the invention the container (for example, for hydraulic fluid) can be easily mounted on the engine front cover, no special mounting arrangements need to be provided on the engine itself. As a result, overall manufacturing cost and also weight are reduced.

Preferably, the mounting means comprises a receptacle integrally formed with the front cover and the container has a mounting portion formed thereon so as to be fittingly received by the receptacle whereby ease of mounting and proper positioning of the container on the front cover are insured since the mounting portion on the container is partially surrounded by the receptacle.

It is advantageous if the receptacle narrows down in longitudinal direction of the engine up to a stop in a wedge-like manner so that the mounting portion of the container can be easily pressed into the receptacle and be firmly supported therein.

To insure firm engagement of the mounting portion with the receptacle under any operating condition, the mounting portion on the container which is of plastic may be provided with means accommodating any tolerances between the mounting portion of the container and the receptacle.

If the container includes a nozzle stub by which it can be directly connected to a connecting pipe or opening of an accessory, there is no need for a separate conduit such as a hose to be provided between the container and the associated accessory.

In order to firmly secure the container mounting portion in the receptacle, it may be locked in position by a retaining clip which is integrally formed with the mounting portion and which engages the receptacle when the mounting portion is inserted into the receptacle. Such an arrangement is simple and provides for fast assembly whereby the manufacturing costs are further reduced.

An exemplary embodiment of the invention will be described below on the basis of the accompanying drawings.

DESCRIPTION OF A PREFERRED EMBODIMENT

Figure 1:
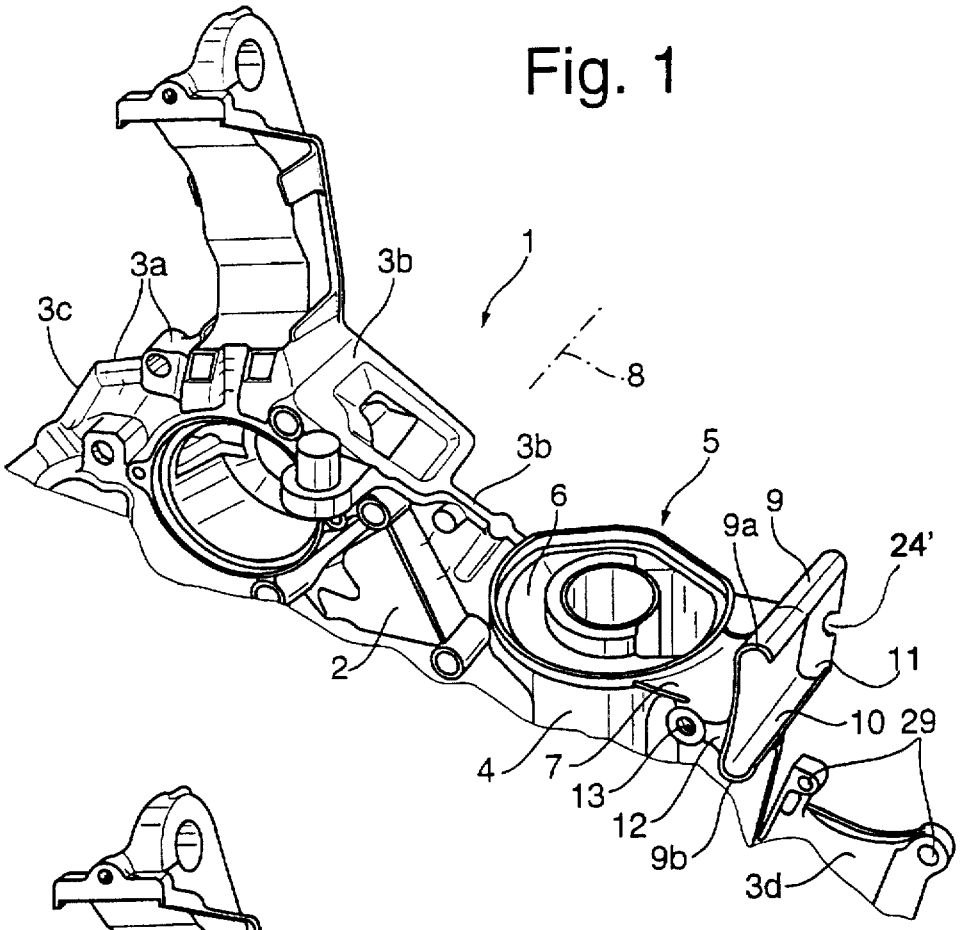
FIG. 1 shows a top portion of an engine front cover showing a structure for supporting various accessories and also a receptacle for receiving the mounting portion of a fluid container which serves as a fluid reservoir for an accessory drive.

FIG. 1 shows the top portion of a unitary front cover 1 of cast aluminum for an engine which is not shown. The engine front cover is mounted onto the front end of an engine and serves to cover the chain drive for the engine camshaft or shafts.

The engine front cover includes structure for supporting engine accessory units such as an alternator, an a/c compressor, a power steering pump, a belt tensioner, a water pump, a cooling water thermostat, an oil filter and an oil cooler.

The engine front cover 1 comprises a front wall 2 which extends parallel to, and at a certain distance from, the front side of the engine block of the internal combustion engine which is not shown in the drawings. The front wall 2 is provided with side walls 3*a*, 3*b*, 3*c* and 3*d*, which extend from the front wall at a right angle toward the internal combustion engine and by way of which the front cover is mounted onto the front end of the engine.

At the outside 4 of the front cover remote from the engine, the engine front cover 1 is provided, at a marginal area 5 thereof, with an oil filter housing structure 6 which is integrally cast with the front cover and which serves to receive an oil filter which however is not shown. At its front end the front cover 1 is provided adjacent the oil filter housing structure 6, that is adjacent its end 7, which is remote from the front cover 1, with a receptacle 9 of a slide-in mount 10 which extends in the longitudinal direction 8 of the engine.

The receptacle 9 which is integrally formed with the front cover 1 is formed in the shape of a recess which extends in the longitudinal direction 8 of the engine and narrows down, wedge-like, toward a stop 11. Adjacent the lower end 12 of the receptacle 9 near the oil filter housing structure 6, there is provided a threaded bore 13.

Below the receptacle 9, there is a support structure 29 for mounting a power steering pump which is not shown but which is disposed on the outside of the wall 3*d* of the front cover 1. The power steering pump includes at its top a nozzle portion directed toward the engine for connection to a hydraulic fluid supply.

Figure 2:
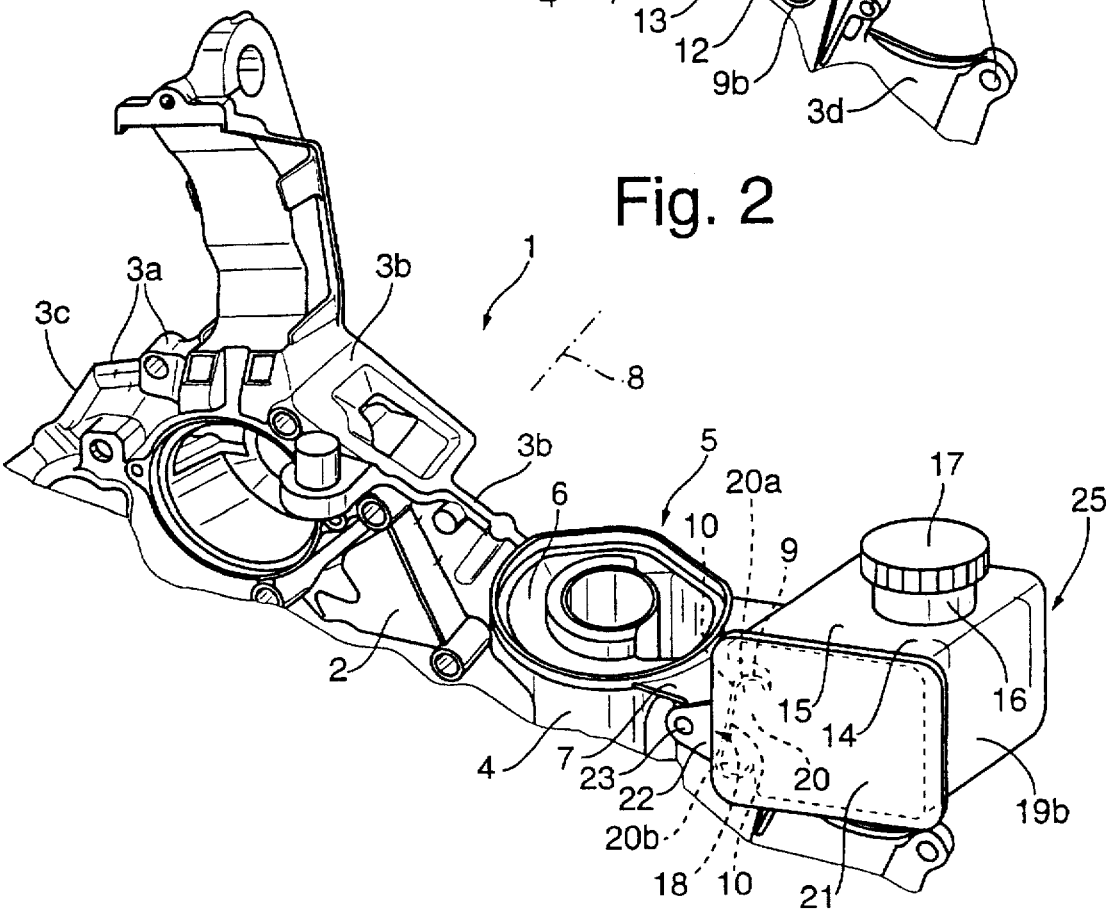
FIG. 2 shows the arrangement of FIG. 1 with the container inserted into the receptacle.

FIG. 2 shows the front cover 1 with a container 14 mounted thereon. A portion 20 corresponding to the receptacle recess of the slide-in mount 10 is integrally formed with the container 14 at its side 19*a* adjacent the oil filter housing structure 6 (see FIG. 3) and is connected to the front cover 1 by sliding the portion 20 of the container 14 into the receptacle 9 of the front cover 1. The corresponding portion 20 of the container 14 includes two projections 20*a* and 20*b* which are received between the opposite end areas 9*a* and 9*b*

(see FIG. 1) of the receptacle 9 of the front cover 1 which forms a U-shaped clamping rail. The receptacle 9 extends around the portion 20 whose outer shape corresponds essentially to the interior shape of the receptacle. The container portion 20 includes means for accommodating tolerances resulting from differential heat expansion of the container portion 20 and the receptacle 9 during the operation of the internal combustion engine.

The container 14 consists of plastic and is provided at its top 15 with an oil filler nozzle 16 which can be closed by a lid 17. In a lower area 18 at the front 21 of the container 14 adjacent the oil filter housing 6, the container has a projection 22 with an opening 23. If the container or rather the slide in mount 10 is inserted into the receptacle, the opening 23 is disposed directly adjacent the threaded bore 13 of the receptacle 9. Then a screw can be inserted through the opening 23 and threaded into the bore 13 whereby the container 14 is fastened in position.

Figure 3:
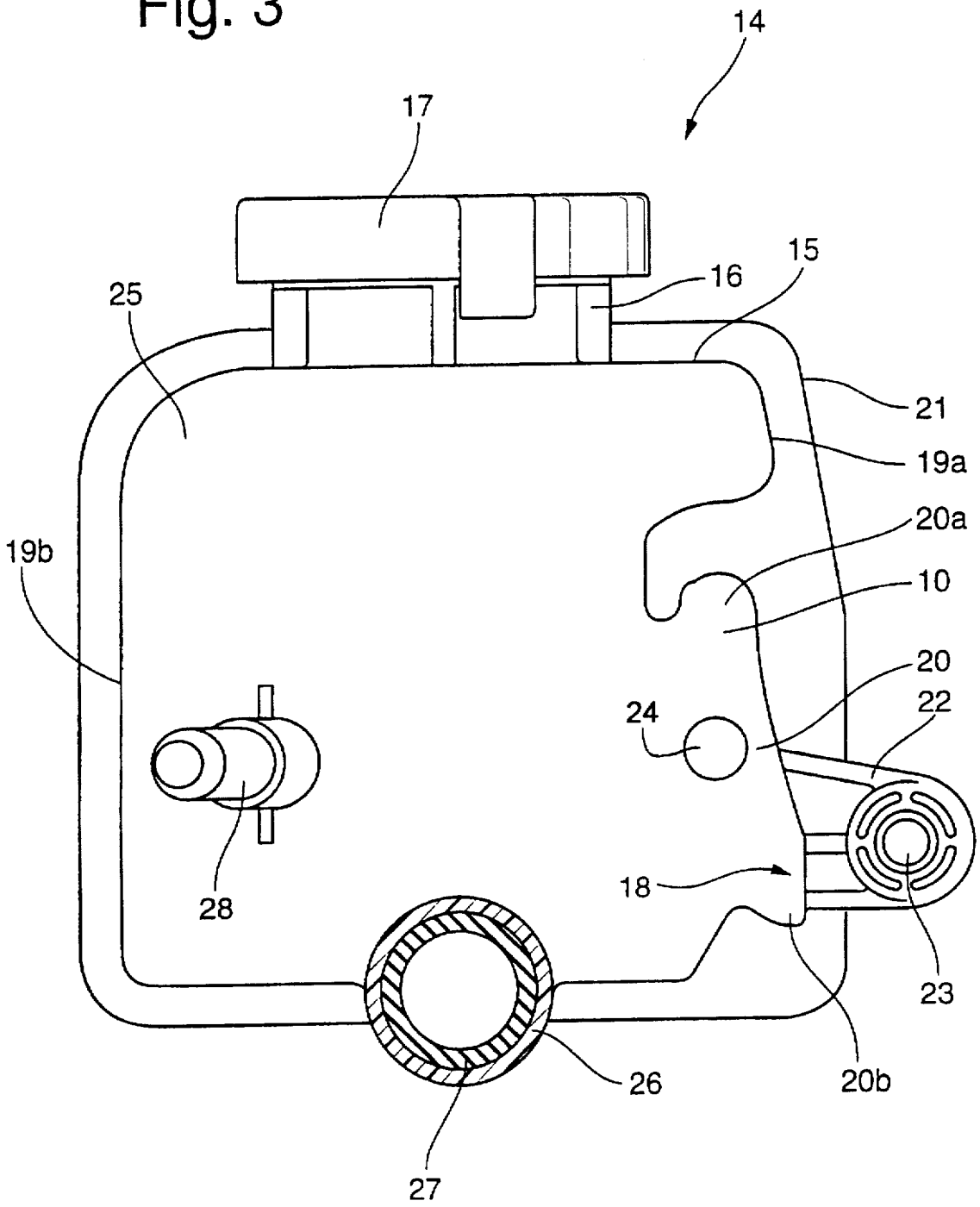
FIG. 3 shows the top portion of the fluid container of FIG. 2.

FIG. 3 shows the backside of the container 14 which serves as fluid reservoir for the power steering pump. At its backside 25 adjacent the engine, the container 14 includes a connecting nozzle 26 with a seal 27 and a power steering fluid return nozzle 28 for a power steering fluid return line connected to the power steering pump. The connecting nozzle 26 has a larger diameter than the return nozzle 28.

When the portion 20 of the container 14 is inserted into the receptacle 9 of the front cover 1, the connecting nozzle 26 of the container 14 receives a connecting nozzle of the power steering pump whereby the power steering pump and the container 14 are placed into communication with one another. Consequently, hydraulic fluid can be supplied to the power steering pump without the need for a conduit between the two. By way of a line extending between the power steering pump and the return nozzle 28, power steering fluid may be returned from the power steering pump to the container 14. The connecting nozzle 26 consists of resilient plastic and is preferably formed integrally with the container 14.

The container 14 can also be connected to the front cover 1 by means of a safety clip structure 24 which is arranged on the backside 25 of the container in the area of the receptacle 9 and which is received and engaged in a clip retaining recess 24' in the receptacle 9 when the portion 20 of the container 14 is inserted into the receptacle 9. Alternatively, the container may be engaged directly with the front cover 1 by means of a clip connection.

As shown in the figures, the mounting portion 20 of the container 14 is received within the receptacle 9. Alternatively, of course, the receiving structure may be part of the container 14 and the front cover may be provided with a mounting portion which is received on the receiving structure integrally formed with the container 14. Also, instead of being received in the connecting nozzle 26, the connecting nozzle 26 may be smaller and may extend into an opening in the power steering pump.

What is claimed is:

1. A front cover for an internal combustion engine mounted on the front end of the engine to cover an engine camshaft drive mechanism and including means for supporting auxiliary engine components such as a generator, an a/c compressor, a power steering pump and a water pump, said front cover further including a slide-in mounting structure supporting a container which is operatively connected to, and supported by, said front cover upon sliding said container into said slide-in mounting structure.

2. A front cover according to claim 1, wherein said slide-in mounting structure comprises a receptacle integrally formed with said front cover and a mounting portion corresponding in shape to said receptacle and being integrally formed with said container.

3. A front cover according to claim 1, wherein said receptacle extends in the longitudinal direction of the engine and includes an engagement structure which narrows wedge-like toward one end of said receptacle where a stop is provided.

4. A front cover according to claim 1, wherein said portion of said container received in said receptacle includes means for compensating for varying sizes.

5. A front cover according to claim 2, wherein one of said container and said auxiliary component has a connecting nozzle and the other has a receiving opening sealingly receiving the connecting nozzle when the container is inserted into said receptacle.

6. A front cover according to claim 1, wherein said container is secured to said front cover by means of a clip connection engaging said receptacle.

7. A front cover according to claim 1, wherein said container is secured to said front cover by means of a clip connection directly engaging said front cover.

8. A front cover according to claim 6, wherein said clip connection includes a clip mounted on the backside of said container.

* * * * *